United States Patent [19]

Biagini et al.

[11] Patent Number: 4,709,854

[45] Date of Patent: Dec. 1, 1987

[54] SYSTEM FOR REGULATING TEMPERATURE OF HOT WATER IN WALL-HUNG INSTANTANEOUS MIXED GAS HEATING UNITS

[75] Inventors: Giuliano Biagini; Roberto Bartolozzi, both of Florence, Italy

[73] Assignee: Nuovopignone-Industrie Meccaniche e Fonderia S.p.A., Florence, Italy

[21] Appl. No.: 51,498

[22] Filed: May 18, 1987

[30] Foreign Application Priority Data

May 23, 1986 [IT] Italy ..... 20544 A/86

[51] Int. Cl.[4] ..... F24D 3/08

[52] U.S. Cl. ..... 236/20 R; 219/226; 237/19

[58] Field of Search ..... 237/19; 236/20 R, 78 B; 219/330, 225, 226

[56] References Cited

FOREIGN PATENT DOCUMENTS 973854 9/1975 Canada ..... 237/19

2414224 9/1979 France ..... 237/19

0026330 2/1982 Japan ..... 237/19

*Primary Examiner*—William E. Wayner

*Attorney, Agent, or Firm*—Hedman, Gibson, Costigan & Hoare

[57] ABSTRACT

System for regulating temperature of hot water in a wall-hung instantaneous mixed gas heating unit, in which the value of the temperature detected by a sensor inserted on the output of the secondary circuit of the hot water exchanger is compared with a set value, and their difference or error value is sent to the input of an amplifier of proportional-integrational-derivative type (P.I.D.), whose output is connected to one input of a selector of minimum value or power, to the other input of which is sent the difference or error value between the temperature of the heating system water and the corresponding maximum tolerable set temperature. The output of the selector then commands the gas modulating valves through a power amplifier, as well as the gas on/off operating valve through comparison with a signal proportional to the minimum thermal power that can be supplied by the heating unit.

2 Claims, 2 Drawing Figures

Figure 1:
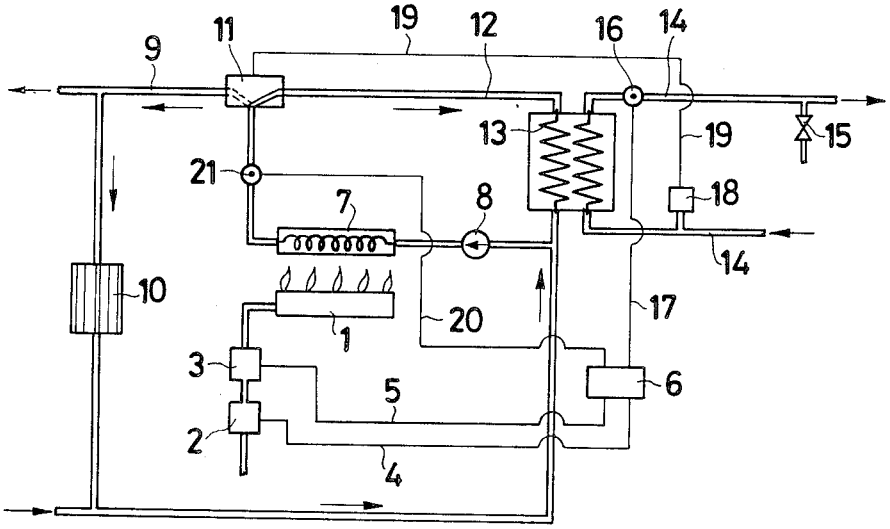

SYSTEM FOR REGULATING TEMPERATURE OF HOT WATER IN WALL-HUNG INSTANTANEOUS MIXED GAS HEATING UNITS

This invention concerns a system for regulating the temperature of the hot water in a wall-hung instantaneous gas heater with dual heat exchanger. This system not only serves to keep the temperature always at a constant level, that of the pre-established set value, regardless of the amount of hot water consumed by the user, thus providing constant supply without abrupt temperature changes, especially important for bath and shower water, but is also capable of limiting the flow of gas to the heating unit in the event that the thermal power required by the hot water is greater than the maximum output of the heating unit, or is less than the minimum necessary to maintain flame stability.

As is well known, a wall-hung instantaneous mixed gas heating unit consists of a burner fed in succession by an electrically-controlled on/off operating valve and a gas modulation valve, also electrically controlled, the burner yielding heat, through a lameller heat exchanger, to the domestic heating system water circulated by a pump through the radiator circuit or, through a three-way valve, into the primary circuit of a second heat exchanger or hot water exchanger in whose secondary circuit the hot water circulates.

Each heating unit is equipped with a control system whose purpose is that of keeping the hot water on outlet from the heating unit at the desired pre-established set value, thus providing the user with a hot water supply that is free from unpleasant temperature changes caused by external disturbances not perfectly compensated for by the control systems such as, typically, variations in the flow of water consumed, variations in the temperature of the water entering the secondary circuit of the hot water heat exchanger, etc.

In the current state of the technology there already exist various types of control systems ranging from mechanical devices to electronic devices with on/off control, to electronic devices with proportional control either on the primary or on the secondary circuit of the hot water heat exchanger, but none of these existing devices is totally capable of keeping the temperature of the hot water on outlet always constant.

The devices of the first type in fact, while substantially sophisticated in concept, are unable to achieve the pre-established objective due to the inherent limitations in a mechanical system deriving from phenomena of hysteresis and friction. In these systems, moreover, the regulation is only proportional and thus there is the intrinsic need for the presence of an error even in normal operating conditions. On the other hand, the devices of the second type, while utilizing an electronic regulator, are unable to provide good performance because of the final actuator which, being of the on/off type, does not allow proportioning of thermal power to the value required for maintaining the correct output temperature.

The devices of the third type tend to keep the temperature of the primary fluid constant, and this would be equivalent to keeping constant the temperature on outlet from the secondary circuit of the hot water heat exchanger only in the case of an ideal heat exchanger. In reality, the heat exchangers which can actually be realized are far from ideal, and moreover the system of regulation of the purely proportional type results in a further impairment of performance, which has stimulated the search for improvement through utilization of devices of the fourth type.

The latter devices control the temperature of the the hot water effectively at the desired point, i.e., on outlet from the hot water exchanger, and are thus potentially able to provide the required performance. Their limitation lies in their utilization in the regulation loop of a control of the proportional type which does not allow nullification of the error at steady state. This type of control, in fact, is characterized by an equation linking the difference between the reference temperature and the temperature under control, termed error e, and the thermal power W on output from the heating unit, of the type:

$$W = Ke$$

where K is the gain in the control loop.

As the amount of hot water drawn from the secondary circuit of the heat exchanger increases, it is obviously necessary, in order to keep the temperature constant, to increase the power supplied. From the preceding equation it can be seen that this increase in power required involves an increase in the error, i.e., a variation in the output temperature which is the less the greater is the gain K, but which however cannot be increased beyond a certain value without incurring in oscillation of the system.

Typical devices designed according to this concept present oscillation in the temperature of the water on outlet in respect to the pre-established value, with a matching variation in flow rate of the water itself between the minimum and maximum values of normal utilization, of more than ten degrees, too pronounced to ensure the required level of comfort.

The purpose of the invention described here is that of overcoming this problem and thus providing a system of regulation of the temperature of the hot water in a wall-hung instantaneous gas heating unit which, by keeping the error always null and by providing a rapid response to variations, ensures that the temperature of the hot water will always remain constant, no matter how much of it is consumed.

Moreover, the system is designed to cut off and/or limit the supply of gas to the heating unit in the event that the thermal power required is beyond a certain normal operating range, more precisely when it is greater than the maximum output that can be supplied by the heating unit, or less than the minimum necessary to avoid flame instability.

This is achieved mainly by inserting into the hot water temperature control loop a device of proportional integrational-differential type (P.I.D.) which, by merit of its integrating effect, allows a constant value to be maintained at its output, and thus a constant thermal power equivalent to the one necessary in that particular operating condition, with null input error. In other words, in the system operating at steady state, no matter what amount of hot water is drawn, and as long as the thermal power required remains within the upper limit of maximum power that can be supplied by the heating unit and the lower limit of minimum power that can be supplied without incurring in flame instability, the temperature of the hot water on output will remain strictly constant at the set value. This characteristic of the P.I.D. is then further complemented by the presence of the derivative action in the regulator, which by informing the gas modulation valve in advance of variations in output improves rapidity of response.

In brief, the control system for the hot water in a wall-hung instantaneous mixed gas heating unit comprising a burner fired by gas through an electrically-controlled on/off operating valve and then through a second gas modulation valve, also electrically controlled, the burner yielding heat, through a lamellar heat exchanger, to the domestic heating system water circulated by a pump through the radiator circuit or, through a three-way valve, into the primary circuit of a heat exchanger in whose secondary circuit, where the hot water circulates, is inserted a flow switch that controls the above-mentioned three-way valve, as well as a hot water temperature sensor, is characterized according to this invention by the fact that the electric signal generated by said hot water temperature sensor is compared with a set electric signal acting as thermostat with a potentiometer, and their error signal or difference is sent on input to an amplifier of the proportional - integrational - derivative type (P.I.D). The output of this amplifier is connected to one input of a minimum power selector, to the other input of which is sent the error signal or difference between the temperature of the heating system water detected by a second sensor in the above-mentioned primary circuit on output from the lamellar heat exchanger, and the maximum tolerable set temperature. The output of this minimum power selector is then sent to command, respectively, the second gas modulation valve through a power amplifier, and the first on/off operating valve, after having been compared with an electric signal proportional to the minimum power that can be supplied by the heating unit.

The invention is more clearly illustrated in the enclosed drawings, which illustrate a preferential form of practical realization given only by way of example, and not as limitation, insofar as technical or structural variations can always be made while remaining within the context of this invention.

In these drawings:

A schematic view of a wall-hung instantaneous gas heating unit with dual heat exchanger, adopting the system of hot water temperature control according to this invention, is shown in FIG. 1.

Figure 2:
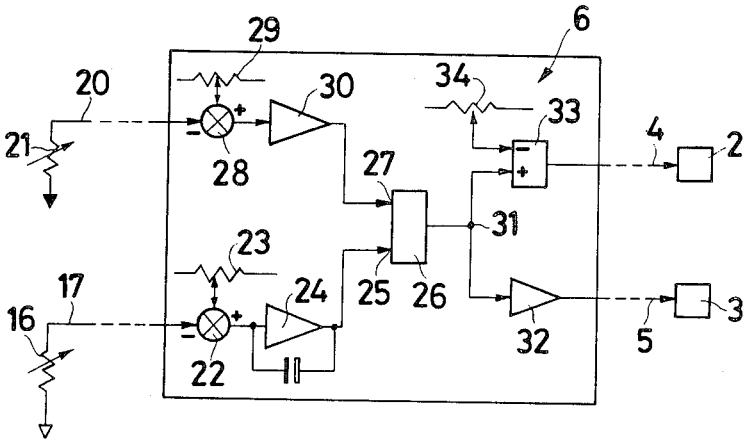

The logic diagram of the control system illustrated in FIG. 1 is shown in FIG. 2.

With reference to the figures, the number 1 indicates the burner of the heating unit which is fired by gas through the on/off operating valve 2 and the modulating valve 3 which are, in turn, electrically controlled, through conductors 4 and 5, by the control loop 6. The heat produced by the burner 1 is yielded in the lamellar heat exchanger 7 to the heating system water, which is circulated by a pump 8 in the circuit 9 of the radiators 10, when the three-way valve 11 is switched to the position shown in dotted line in Fig. 1, or into the primary circuit 12 of the heat exchanger 13 when said valve 11 is switched into the position shown in unbroken line in FIG. 1. In the secondary circuit 14 of the above-mentioned heat exchanger 13 circulates, countercurrent to the heating system water in the primary circuit 12, the hot water which goes to feed the various cocks 15. In the secondary circuit 14, at the output from the heat exchanger 13, is then inserted a sensor 16 for the temperature of the hot water, whose electric signal is sent, through conductor 17, into the control circuit 6, as well as a flow switch 18 which commands, through conductor 19, the three-way valve 11, switching it as shown in FIG. 1 when the opening of a cock 15 results in a flow of hot water, which is detected by the flowmeter itself.

To the control circuit 6 is also sent, through conductor 20, the electric signal proportional to the temperature of the hot water detected by a second temperature sensor 21 inserted in the primary circuit 12 of the heat exchanger 13 on output from the lamellar heat exchanger 7.

More specifically (see FIG. 2), the electric signal proportional to the temperature of the hot water detected by sensor 16 is conveyed, through conductor 17, to a comparator 22 where it is compared with an electric set signal generated through a potentiometer 23 and thus serving the function of thermostat.

The difference or error signal on output from comparator 22 is then sent on input to an amplifier 24 of the proportional - integrational - derivative type, whose output, the electric value of which is proportional to the thermal power required, is forwarded to input 25 of a minimum power selector 26, which compares it with the signal of maximum permissible power generated in the circuit starting at input 27 of selector 26.

This circuit takes the electric signal proportional to the temperature of the heating system water circulating in the primary circuit 12 of heat exchanger 13, detected by sensor 21, and compares it in comparator 28 with a set electric value, entered through potentiometer 29, which represents, in the same scale as that of the sensor, the maximum temperature which should not be exceeded for reasons of safety (slightly lower than the boiling temperature of water). The difference of error signal on output from comparator 28 is then amplified by a high K factor through amplifier 30, so that the signal on input 27 of selector 26 also represents a power that assumes high values as long as the temperature detected by sensor 21 is lower than the maximum set temperature entered through potentiometer 29, while it decreases down to zero when the temperature level detected reaches the maximum permissible value. Consequently, in the first case the minimum power selector 26 will let pass unaltered the signal of amplifier 24, and in the second case that of amplifier 30 which is zero, ignoring in the latter case a possible request for greater power made by the system and thus carrying out the function of protection, which ceases automatically as soon as the temperature of the hot water detected by sensor 21 is not longer at the maximum permissible value.

Output 31 of selector 26 is then forwarded, through power amplifier 32 and the above-mentioned conductor 5, to command the gas modulating valve 3, which therefore delivers to the burner 1 a flow of gas proportional to the electric signal sent to it. In addition, it commands the on/off operating valve 2 through comparison in comparator 33 with an electric signal proportional to the minimum power that should be supplied by burner 1 to maintain flame stability; this signal is generated through potentiometer 34. For values of output 31 lower than this signal, the above-mentioned on/off valve 2 closed off the gas supply.

We claim:

1. System for regulating temperature of hot water in a wall-hung instantaneous mixed gas heating unit comprising a burner fired by gas through a first electrically-controlled on/off operating valve and a second gas modulating valve, also electrically controlled, said burner yielding heat, through a lamellar heat exchanger, to the heating system water circulated by a pump in the radiator circuit or, through a three-way valve, in the primary circuit of a heat exchanger is whose secondary circuit, where the hot water circulates, is inserted a flow switch which commands said three-way valve as well as a hot water temperature sensor, characterized by the fact that the electric signal generated by this hot water temperature sensor is compared with an electric set signal entered through a potentiometer, and their error or difference signal is sent in input to an amplifier of the proportional - integrational - derivative type (P.I.D.), whose output is connected to one input of a minimum power selector, to the other input of which is sent the error or difference signal between the temperature of the heating system water detected by a second sensor in the primary circuit on output from the lamellar heat exchanger, and the maximum tolerable set temperature, the output of this minimum power selector being sent to command the second gas modulating valve through a power amplifier, and the first on/off operating valve after having been compared with an electric signal proportional to the minimum thermal power that can be supplied by the heating unit.

2. System for regulating temperature of hot water in a wall-hung instantaneous mixed gas heating unit, as substantially described and illustrated herein.

* * * * *